US007121415B1

(12) United States Patent
Vizcarra et al.

(10) Patent No.: US 7,121,415 B1
(45) Date of Patent: Oct. 17, 2006

(54) UTENSIL RECEPTACLE

(75) Inventors: Damien Vizcarra, Waltham, MA (US); Allan Cameron, Natick, MA (US); Tonia Giesecke, Cambridge, MA (US); John R. Bussiere, Littleton, MA (US); David W. Laituri, Wayland, MA (US)

(73) Assignee: Helen of Troy Limited, St. Michael (BB)

( * ) Notice: Subject to any disclaimer, the term of this patent is extended or adjusted under 35 U.S.C. 154(b) by 0 days.

(21) Appl. No.: 11/083,732

(22) Filed: Mar. 18, 2005

(51) Int. Cl.
*A47F 7/00* (2006.01)

(52) U.S. Cl. ..... 211/70.7; 211/70.7; 248/37.3; 206/553

(58) Field of Classification Search ..... 211/70.7; 248/37.3; 206/553; D32/55, 3; 47/65.6, 47/66.1, 66.6, 75, 79
See application file for complete search history.

(56) References Cited

U.S. PATENT DOCUMENTS

| | | | | |
|---|---|---|---|---|
| 1,453,437 A | | 5/1923 | Burnham | |
| 1,623,703 A | * | 4/1927 | Ruff | 220/23.87 |
| 1,763,174 A | * | 6/1930 | Morris | 68/237 |
| 2,632,569 A | | 3/1953 | Fledman | |
| 2,666,549 A | | 1/1954 | Horne, Jr. | |
| 2,712,668 A | * | 7/1955 | Thiele | 15/264 |
| D193,641 S | | 9/1962 | Stiller | |
| 3,529,742 A | | 9/1970 | Cumming | |
| 4,318,478 A | | 3/1982 | De Winter | |
| D287,175 S | | 12/1986 | Gecchelin | |
| D307,964 S | * | 5/1990 | Sauter et al. | D32/55 |
| 5,005,711 A | | 4/1991 | Peatross et al. | |
| 5,012,934 A | | 5/1991 | Newhall | |
| D326,394 S | * | 5/1992 | Rymoen | D7/641 |
| 5,184,749 A | | 2/1993 | Attenasio | |
| D334,265 S | | 3/1993 | Giugiaro | |
| D342,813 S | | 12/1993 | Verchere | |
| D363,576 S | | 10/1995 | Brightbill et al. | |
| 5,547,087 A | | 8/1996 | Licari | |
| D395,801 S | | 7/1998 | Miller | |
| D398,663 S | * | 9/1998 | Freelander | D21/532 |
| D402,777 S | | 12/1998 | Miller | |
| 6,062,397 A | | 5/2000 | Licari | |
| 6,505,746 B1 | | 1/2003 | Johnson | |

* cited by examiner

*Primary Examiner*—Richard E. Chilcot, Jr.
*Assistant Examiner*—Lindsay M. Maguire
(74) *Attorney, Agent, or Firm*—Seyfarth Shaw LLP

(57) ABSTRACT

An embodiment of a utensil receptacle is disclosed including a peripheral wall structure having an upper end defining a top opening, a lower end and a substantially oval cross-section, an outer base member being releasably engageable to the lower end, a caddy configured to releasably engage the outer base member and including a bottom wall having holes, and a drainage tray for collecting fluids flowing through the holes.

19 Claims, 5 Drawing Sheets

UTENSIL RECEPTACLE

TECHNICAL FIELD

This application relates generally to receptacles that include a removable drainage basin for storing utensils used in and around a kitchen or the like. More particularly, the application relates to a utensil receptacle that collects dripping fluid and is capable of being stored in a narrow area, while being sufficiently able to be conveniently disassembled for cleaning.

BACKGROUND

Numerous devices disclosed in the prior art are capable of storing utensils that are wet and have means for collecting water dripping therefrom in a separate reservoir. Generally, such receptacles remain in place and are stored when the drying process is complete or the receptacle is no longer required, with articles contained therein emptied prior to storage. Other receptacles typically include removable draining mechanisms that are particularly adapted to hold and drain dishes and the like, which are also emptied and returned to storage.

Prior art devices adapted to hold and store utensils that tend to drip water after washing so that these utensils, such as spatulas, whisks, wooden spoons and the like, are displayed and available for use at a later time are also known. Such receptacles or "caddies" may hold the utensils in a single container that collects the drippings in a second container that is slidably mounted to the first container. However, caddies of this type form the utensil receptacle itself and are not capable of being disassembled for straightforward cleaning.

SUMMARY

There is disclosed herein an improved utensil receptacle which includes improved cleaning and drainage features.

An object of this invention is to provide an improved receptacle for holding and storing utensils that includes a removable caddy, caddy support and drainage try for collecting the fluids dripping off of such utensils.

Another object of this invention is to provide an improved receptive for holding and storing utensils that includes a removable caddy, caddy support and drainage try for simplified cleaning.

Yet another object of the invention is to provide a caddy with holes for draining fluids, the holes configured to prevent excess movement of the utensils contained in the receptacle.

An illustrative embodiment of the present invention relates to a utensil receptacle including a peripheral wall structure having an upper end defining a top opening, a lower end and a substantially oval cross-section an outer base member being releasably engageable to the lower end, a caddy configured to releasably engage the outer base member and including a bottom wall having holes, and a drainage tray for collecting fluids flowing through the holes.

A more detailed explanation of the invention is provided in the following description and claims and is illustrated in the accompanying drawings.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
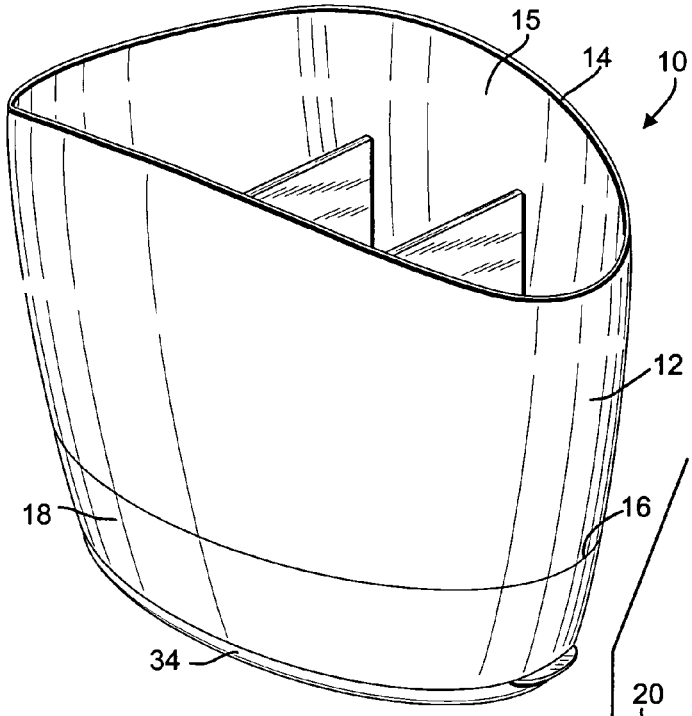
FIG. 1 is a perspective view of an embodiment of the utensil receptacle of the present invention.
Figure 2:
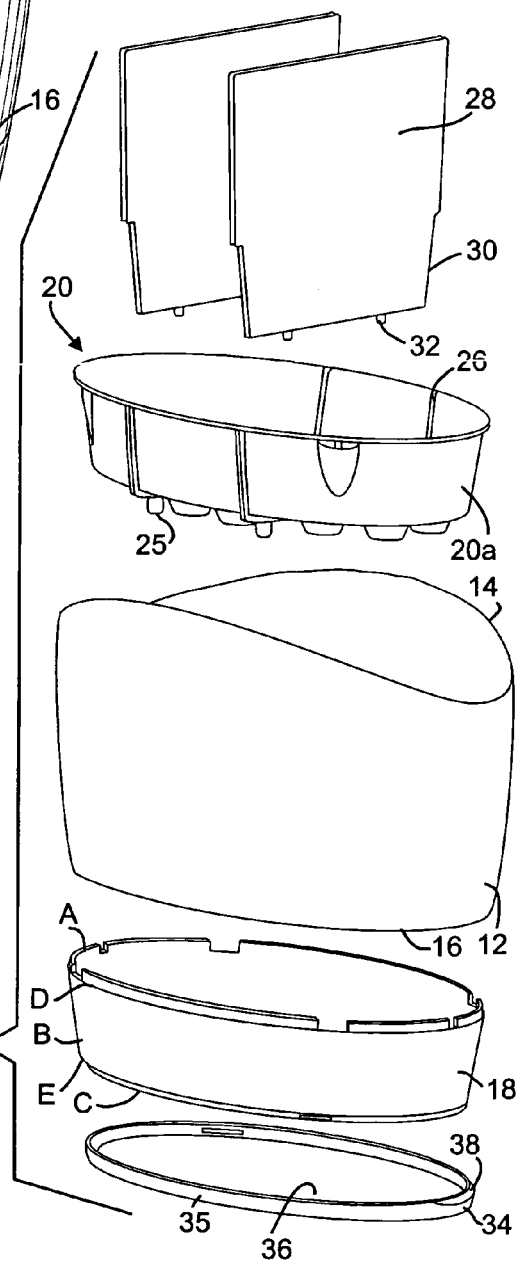
FIG. 2 is an exploded perspective view of the embodiment of the utensil receptacle of FIG. 1.

Referring to FIGS. 1 and 2, there is illustrated a utensil receptacle 10, which is preferably of more than one piece, but may be of unitary, one-piece construction. The utensil receptacle 10 has a peripheral wall structure 12, which is substantially oval in shape and preferably generally slopes inwardly from an upper end 14 to a lower end 16 thereof, both the upper end 14 and the lower end 16 defining openings 15, which are also generally oval in shape. Since peripheral wall structure 12 preferably slopes inwardly from the upper end 14 to the lower end 16, the oval opening of lower end 16 has a cross-section that is less in area than that of upper end 14. The peripheral wall structure 12 is dimensioned facilitate storage in narrow areas, thus, while an oval shape is preferred, other configurations are suitable as well.

Figure 3:
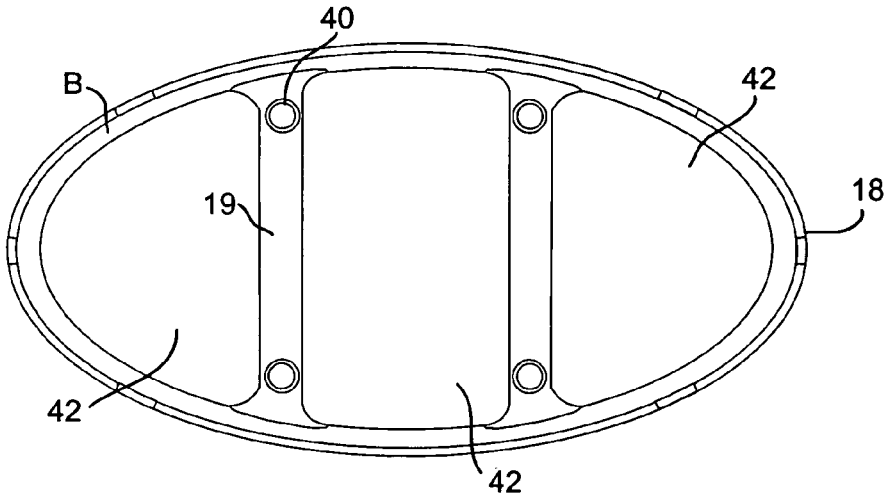
FIG. 3 is a top elevational view of the outer base member of FIG. 2.

Utensil receptacle 10 further includes an outer base member, or caddy support, 18. As further illustrated in FIGS. 2 and 3, the outer base member 18 preferably releasably engages the lower end 16 of peripheral wall 12. In an embodiment, the outer base member 18 has an upper wall structure 18A having a width that is less than the width of peripheral sidewall structure 18B, thereby forming a shoulder 18D. In operation, as outer base member 18 is coupled to the lower end 16 of peripheral wall structure 12, upper wall structure 18A enters the opening defined by the lower end 16, with the lower end 16 coming to rest on shoulder 18D. The upper wall structure 18A is preferably dimensioned and configured to form an interference or friction fit with the lower end 16.

Similarly, the outer base member 18 preferably releasably engages a drainage tray 34. In an embodiment, the outer base member 18 has an lower wall structure 18C having a width that is less than the width of peripheral sidewall structure 18B, thereby forming a shoulder 18E. In operation, as outer base member 18 is coupled to the drainage tray 34, lower wall structure 18C enters an interior of the drainage tray 34 defined by peripheral wall structure 35 and bottom wall 36, with the peripheral wall structure 35 coming to rest on shoulder 18E. The lower wall structure 18C is preferably dimensioned and configured to form an interference or friction fit with the peripheral wall structure 35 of the drainage tray 34.

Referring again to FIG. 3, an embodiment of outer base member 18 of the present invention may include at least one caddy support member 19. The caddy support members 19 may include receptacles 40 for releasably receiving securements 25 of caddy 20 (shown in FIGS. 2, 4A and 4B), as further detailed below. Outer base member 18 preferably further includes at least one opening 42. In the embodiment illustrated in FIG. 3, at least one opening 42 is sectioned by a caddy support members 19.

Figure 4A:
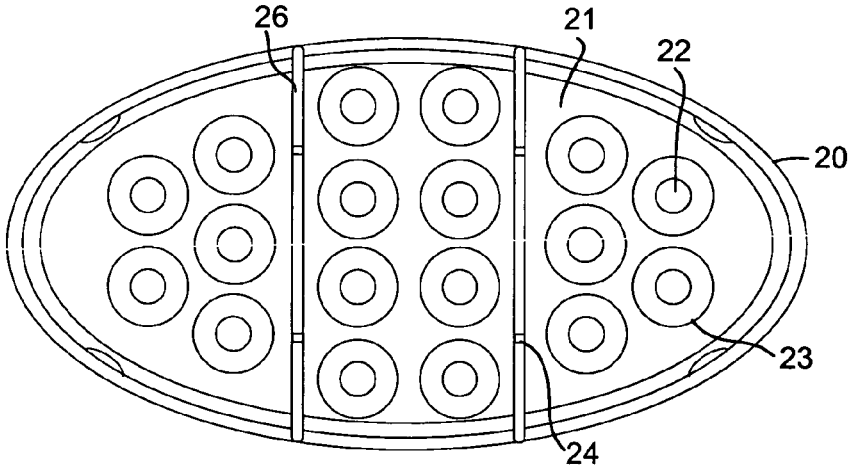
FIG. 4A is a top elevational view of the caddy of FIG. 2.
Figure 4B:
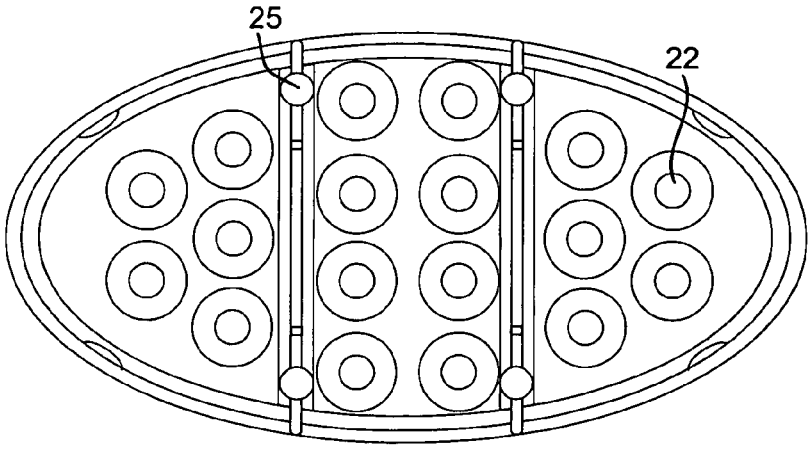
FIG. 4B is a bottom elevational view of the caddy of FIG. 3.
Figure 5A:
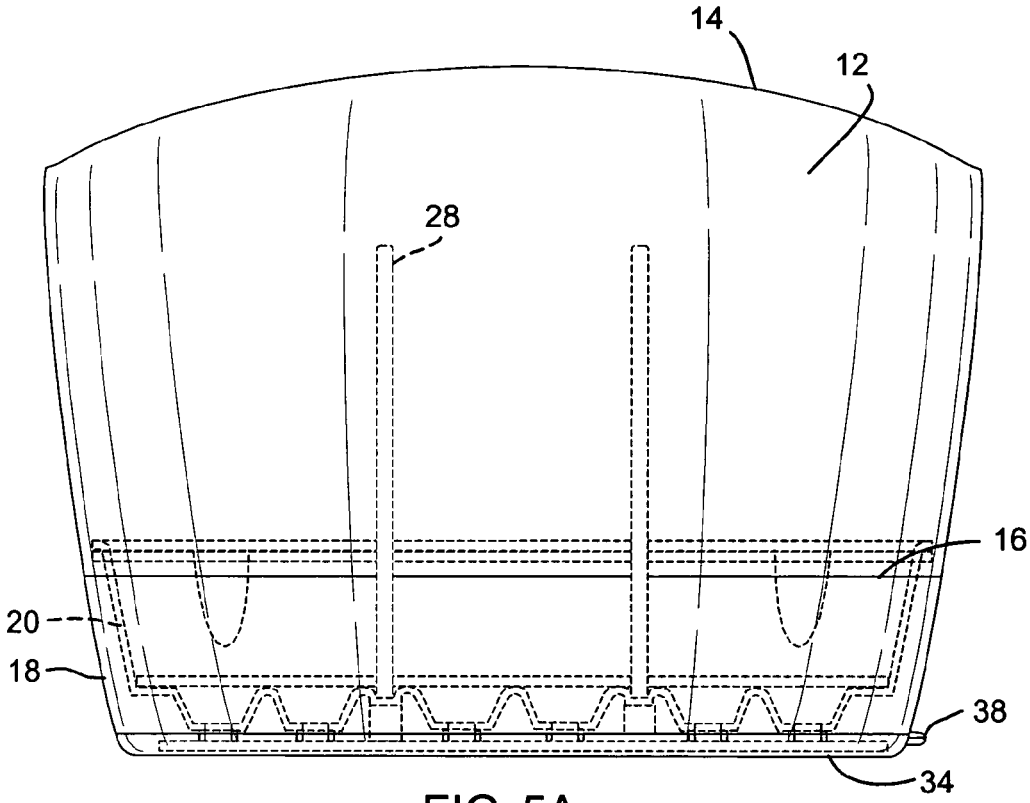
FIG. 5A is a side elevational view of one side of the embodiment of FIG. 1.
Figure 5B:
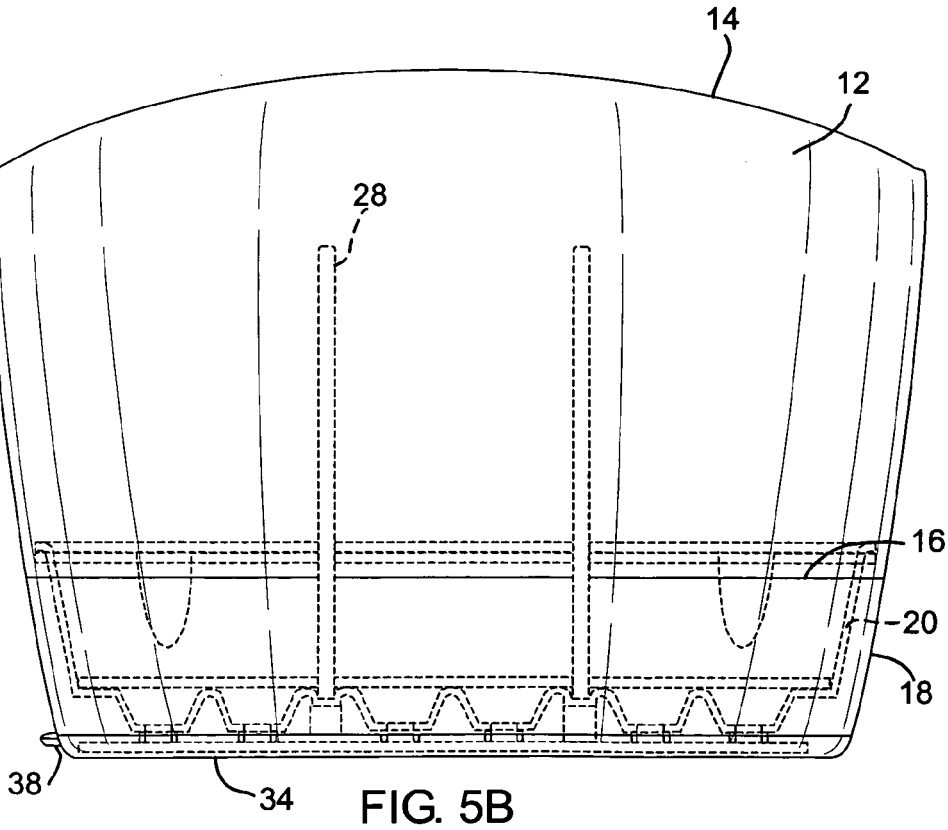
FIG. 5B is a side elevational view of the other side of the embodiment FIG. 1.
Figure 5C:
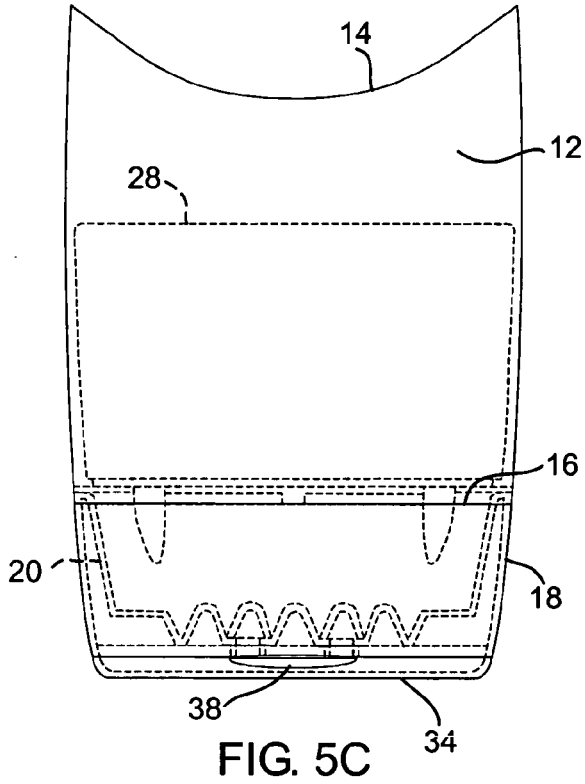
FIG. 5C is an elevational view of one end of the embodiment of FIG. 1.
Figure 5D:
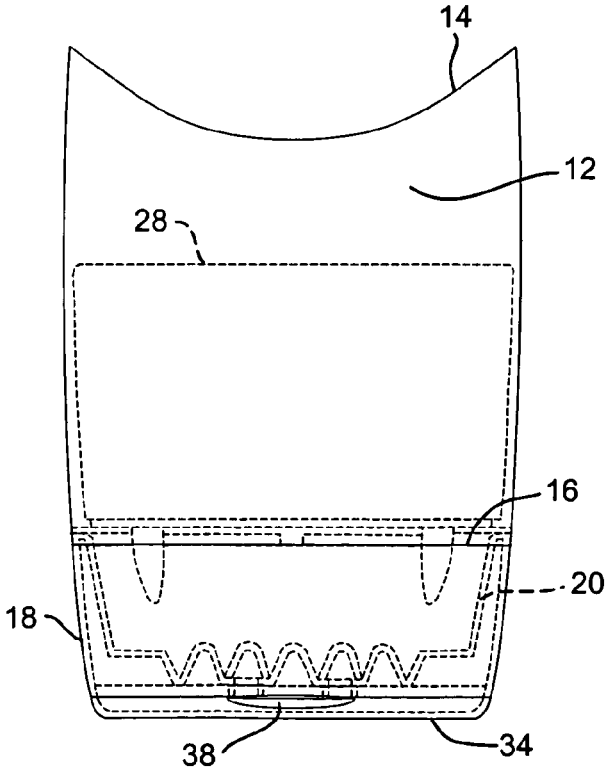
FIG. 5D is an elevational view of the other end of the embodiment of FIG. 1.
Figure 5E:
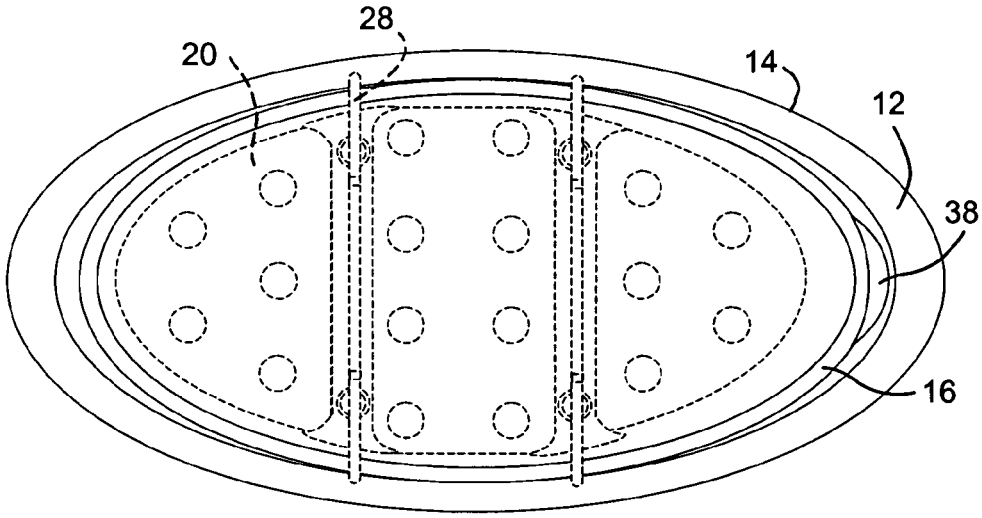
FIG. 5E is a top plan view of the embodiment of FIG. 1.
Figure 5F:
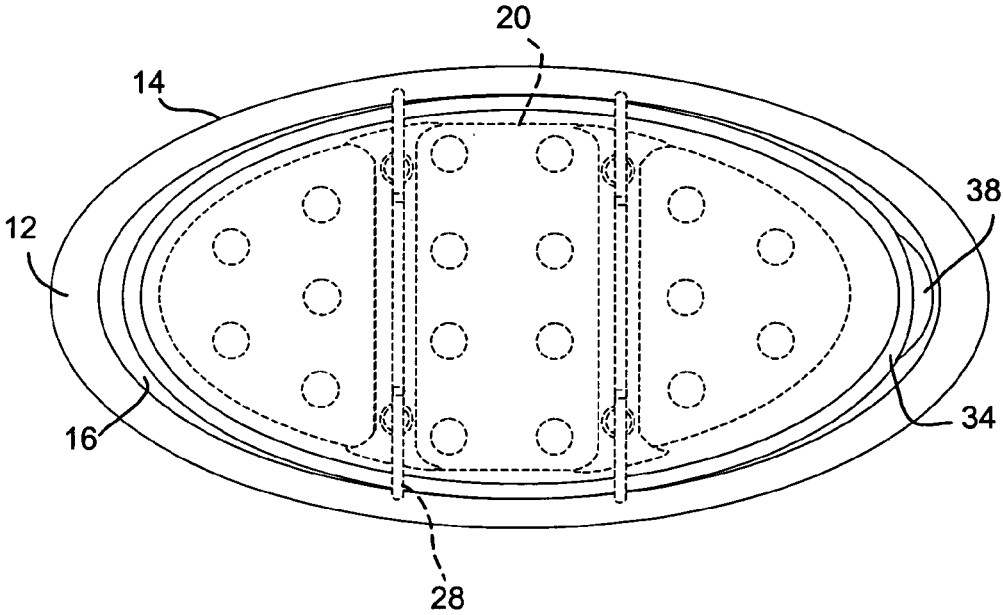
FIG. 5F is a bottom plan view of the embodiment of FIG. 1.

Referring now to FIGS. 2, 4A and 4B, utensil receptacle 10 further includes a caddy 20. In the embodiments of the present invention illustrated in FIGS. 2 and 4, caddy 20 has a peripheral sidewall structure 20A incorporating grooves 26 to accommodate partitions 28. Partitions 28 include groove engagement regions 30 for slidable engagement with the grooves 26. The partitions 28 may further include securements 32 for engaging receptacles 24 of a bottom structure 21. The bottom structure 21 incorporates holes 22 to permit the drainage of fluid out of the caddy 20, through outer base member 18 and into drainage tray 34 for collection. The holes 22 are preferably positioned at the end of conical depressions 23 in bottom structure 21, with a wider end of the conical depressions 23 in the bottom wall and a narrower end terminating at hole 22. In an embodiment, the conical depressions 23 reduce or prevent the utensils from sliding along the bottom structure 21.

The assembly operation of the embodiment of the utensil receptacle 10 illustrated in FIGS. 1–5F, may proceed with the outer base member 18 being coupled to the lower end 16 of peripheral wall structure 12 through an interference fit, with upper wall structure 18A entering the opening defined by the lower end 16, the lower end 16 coming to rest on shoulder 18D. The caddy 20, with or without the partitions 28, may then be lowered through the opening 15 defined by the upper end 14 of peripheral wall structure 12, with securements 25 that project from a lower surface of bottom structure 21 coupling with the receptacles 40 of caddy support members 19 to releasably secure caddy 20 to outer base member 18. The drainage tray may then be coupled to the outer base member 18, with the lower wall structure 18C entering the interior of the drainage tray 34 defined by peripheral wall structure 35 and bottom wall 36, with the peripheral wall structure 35 coming to rest on shoulder 18E. The bottom wall 36 of the drainage tray 34 is positioned a distance below the holes 22, forming a gap between holes 22 and bottom wall 36 so as not to restrict the flow of fluid out of caddy 20.

In facilitating the disassembly of the embodiment of the utensil receptacle 10 illustrated in FIGS. 1–5F, a lip or protrusion 38 may be formed integrally with peripheral wall structure 35, so that a user can more easily apply the force required to disengage the drainage tray 34 from the outer base member 18. Additionally, it is preferred that partitions 26 require a greater force applied thereto in order to be disengaged from caddy 20 than the force required to disengage securements 25 of caddy 20 from the receptacles 40 of outer base member 18, thereby permitting the user to remove the caddy 20 from the interior of utensil receptacle 10 using the partitions 26.

A utensil receptacle as detailed herein may be utilized in various forms. One such receptacle may be useful for a caddy with partitions, for purposes such as separating different types of utensils. Another such receptacle may incorporate a counter-weight in the outer base member, so as to reduce the likelihood of the utensil receptacle tipping over under weight against the upper end of the peripheral wall structure. From the foregoing, it can be seen that there has been provided an improved utensil receptacle which greatly facilitates the cleaning of the components thereof, as well as an improved caddy that reduces or prevents the utensils from sliding along the bottom thereof.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A utensil receptacle comprising:

a peripheral wall structure having an upper end defining a top opening, a lower end and a substantially oval cross-section;

an outer base member being releasably engageable to the lower end;

a caddy removably disposable in the peripheral wall structure and configured to releasably engage the outer base member and including a bottom wall having holes; and a drainage tray removably coupled to the outer base member for collecting fluids flowing through the holes.

2. The utensil receptacle according to claim 1, wherein the peripheral wall structure slopes inwardly from the upper end to the lower end.

3. The utensil receptacle according to claim 1, wherein the outer base member includes at least one caddy support member.

4. The utensil receptacle according to claim 3, wherein the caddy releasably engages the at least one caddy support member.

5. The utensil receptacle according to claim 1, wherein the caddy includes a bottom structure having conical depressions.

6. The utensil receptacle according to claim 5, wherein the holes are formed in the conical depressions.

7. The utensil receptacle according to claim 6, wherein the conical depressions restrict the movement of utensils.

8. The utensil receptacle according to claim 1, wherein the drainage tray includes a lip formed integrally therewith.

9. The utensil receptacle according to claim 1, wherein the lower end has a substantially oval cross-section smaller than a substantially oval cross-section of the upper end.

10. A utensil receptacle comprising:

a peripheral wall structure having an upper end defining a top opening, a lower end and a substantially oval cross-section;

a caddy assembly removably coupled to the lower end, the caddy assembly including an outer base member and a caddy removably connected to the outer base member, said caddy having a bottom wall having holes.

11. The utensil receptacle according to claim 10, wherein the peripheral wall structure slopes inwardly from the upper end to the lower end.

12. The utensil receptacle according to claim 10, wherein the outer base member is removably coupled to the lower end and includes at least one caddy support member.

13. The utensil receptacle according to claim 12, wherein the caddy releasably engages the at least one caddy support member.

14. The utensil receptacle according to claim 10, wherein the caddy includes a bottom structure having conical depressions.

15. The utensil receptacle according to claim 14, wherein the holes are formed in the conical depressions.

16. The utensil receptacle according to claim 15, wherein the conical depressions restrict the movement of utensils.

17. The utensil receptacle according to claim 10, and further comprising a drainage tray removably coupled to the caddy assembly for collecting fluids flowing through the holes.

18. The utensil receptacle according to claim 17, wherein the drainage tray includes a lip formed integrally therewith.

19. The utensil receptacle according to claim 10, wherein the lower end has a substantially oval cross-section smaller than a substantially oval cross-section of the upper end.

* * * * *